US005502770A

United States Patent [19]

Kuo et al.

[11] Patent Number: 5,502,770

[45] Date of Patent: Mar. 26, 1996

[54] INDIRECTLY SENSED SIGNAL PROCESSING IN ACTIVE PERIODIC ACOUSTIC NOISE CANCELLATION

[75] Inventors: Sen M. Kuo, Houston, Tex.; Minjiang Ji, DeKalb, Ill.; M. Kathryn Christensen, Lenexa, Kans.; Robert A. Herold, Peoria Heights, Ill.

[73] Assignee: Caterpillar Inc., Peoria, Ill.

[21] Appl. No.: 158,328

[22] Filed: Nov. 29, 1993

[51] Int. Cl.[6] ..... G10K 11/16

[52] U.S. Cl. ..... 381/71; 381/94

[58] Field of Search ..... 381/71, 94; 415/119; 267/136

[56] References Cited

U.S. PATENT DOCUMENTS

| | | | |
|---|---|---|---|
| 4,122,303 | 10/1978 | Chaplin et al. | 179/1 P |
| 4,153,815 | 5/1979 | Chaplin et al. | 179/1 P |
| 4,417,098 | 11/1983 | Chaplin et al. | 381/94 |
| 4,423,289 | 12/1983 | Swinbanks | 381/71 |
| 4,480,333 | 10/1984 | Ross | 381/71 |
| 4,489,441 | 12/1984 | Chaplin | 381/71 |
| 4,490,841 | 12/1984 | Chaplin et al. | 381/71 |
| 4,506,380 | 3/1985 | Matsui | 381/71 |
| 4,527,282 | 7/1985 | Chaplin et al. | 381/71 |
| 4,566,118 | 1/1986 | Chaplin et al. | 381/71 |
| 4,589,133 | 5/1986 | Swinbanks | 381/71 |
| 4,596,033 | 6/1986 | Swinbanks | 381/71 |
| 4,600,863 | 7/1986 | Chaplin et al. | 318/114 |
| 4,637,048 | 1/1987 | Swinbanks | 381/71 |
| 4,654,871 | 3/1987 | Chaplin et al. | 381/72 |
| 4,669,122 | 5/1987 | Swinbanks | 381/71 |
| 4,862,506 | 8/1989 | Landgarten et al. | 381/71 |
| 4,977,600 | 12/1990 | Ziegler | 381/71 |
| 4,987,598 | 1/1991 | Eriksson | 381/71 |
| 5,052,510 | 10/1991 | Gossman | 180/300 |
| 5,097,923 | 3/1992 | Ziegler et al. | 181/206 |
| 5,105,377 | 4/1992 | Ziegler, Jr. | 364/724.01 |
| 5,126,681 | 6/1992 | Ziegler et al. | 328/165 |
| 5,146,505 | 9/1992 | Pfaff et al. | 381/71 |
| 5,219,037 | 6/1993 | Smith et al. | 180/312 |
| 5,221,185 | 6/1993 | Pla et al. | 381/71 |
| 5,222,148 | 6/1993 | Yuan | 381/94 |

FOREIGN PATENT DOCUMENTS

| | | |
|---|---|---|
| 0340974 | 11/1989 | European Pat. Off. . |
| 0479367 | 8/1992 | European Pat. Off. . |
| 3106029 | 9/1982 | Germany . |
| 2265277 | 9/1993 | United Kingdom . |

OTHER PUBLICATIONS

D. C. Perry et al.—"The Use of DSP for Adaptive Noise Cancellation for Road Vehicles"—Session 3, Paper 3, pp. 3.3.1 to 3.3.8.

J. C. Stevens—"An Experimental Evaluation of Adaptive Filtering Algorithms for Active Noise Control" GRTI/AERO pp. 1–10.

*Primary Examiner*—Stephen Brinich

*Attorney, Agent, or Firm*—Alvin J. Riddles

[57] ABSTRACT

The system employing and the processing of, an indirectly sensed signal representative of a periodic noise acoustic wave into an input signal for a noise cancelling system where the indirectly sensed signal is converted into a pulse signal per period that carries fundamental and harmonic frequency information of the periodic noise. A tachometer type RPM signal is processed in a counter circuit controlled by a logic circuit to produce a signal of one pulse per revolution with a controlled duration, the pulse amplitude is adjusted, the pulses are low pass filtered and any D.C. is blocked from the noise cancelling system input.

17 Claims, 3 Drawing Sheets

INDIRECTLY SENSED SIGNAL PROCESSING IN ACTIVE PERIODIC ACOUSTIC NOISE CANCELLATION

FIELD OF THE INVENTION

The invention relates to the active acoustic cancellation of noise from a periodic source such as repetitive machinery, and in particular to the processing of indirectly sensed signals representative of noise for use as input to an active acoustic noise cancellation system.

BACKGROUND AND RELATION TO THE PRIOR ART

Active noise cancellation involves superimposing on a noise acoustic wave an opposite acoustic wave that destructively interferes with and cancels the noise wave. The active noise cancellation principle is most useful at predetermined frequencies in the active noise cancellation range.

In active noise cancellation systems the characteristics of the noise acoustic wave are sensed, a cancelling acoustic wave is produced and delivered to a location through a speaker. The combined waves are monitored at the location and a feedback or error signal is produced for iterative adjustment of the cancelling acoustic wave.

Implementations of the active noise cancellation principle are arranged to accommodate changes in the frequency and intensity characteristics of the noise acoustic wave by incorporating adaptability into the feedback or error path of the active noise cancellation system. The changes are accommodated through iterative incremental computations, based on the noise acoustic wave input signal and the error signal, in a procedure known in the art as an algorithm, which in turn is implemented through digital signal processing (DSP) in semiconductor chip active noise controller devices.

A number of algorithms with adaptability that are suitable for digital signal processing have evolved in the art. A survey article by J. C. Stevens entitled "An Experimental Evaluation of Adaptive Filtering Algorithms for Active Noise Control", Georgia Institute of Technology, GRTI/AERO, Atlanta, Ga. 1992 Pages 1–10, provides an illustrative description of the current capabilities in the art.

The active noise cancellation principle has been applied extensively in the art where the system can be constructed so that the noise source is localized and the operations of sensing, cancelling and monitoring can occur serially, as in ducts and pipes. An illustrative example is U.S. Pat. No. 4,987,598.

Active noise cancelling systems exhibit instability when the cancelling signal gets into the noise acoustic wave prior to the sensing of the characteristics of the noise acoustic wave. Heretofore in the art this has been handled by care in constructing a system to prevent the situation and to some extent by modification of the algorithm to accommodate it.

Situations are being encountered, particularly in such places as vehicles, where the use of an indirectly sensed signal such as from a tachometer or accelerometer that is representative of the noise acoustic wave would be useful. Examples of such situations are: where there is limited flexibility in arranging a system to prevent a cancelling signal from reaching a direct acoustic input; and where particular types of sounds such as music and warning signals should not be cancelled.

An example of early effort for vehicles is an article by Perry et al entitled "The Use of DSP for Adaptive Noise Cancellation for Road Vehicles", Paper No. 3, Session 3, Pages 331 to 338, in which tachometer or ignition based indirect sensing of the acoustic noise is processed in a controller to provide a cancelling signal for sound in an entire multi occupant enclosure through the use of a plurality of peripherally mounted speakers with monitoring through microphone pairs at each occupant seat.

A principal problem with indirect signal sensing has been that the indirectly sensed signal, while related to the noise acoustic wave that is to be cancelled, is not correlated closely enough to it to contain all the characteristics essential to efficient algorithm computations and effective noise cancellation. Recent efforts in the art avoid the problem by having table look up arrangements that use the indirectly sensed signal to guide the arrangement. Examples are U.S. Pat. 4,506,380 Nos. and 5,146,505.

A need is present in the art for the ability to correlate an indirectly sensed signal representative of an actual noise acoustic wave with the essential aspects of that actual noise acoustic wave and for a system of using direct and indirect sensing.

SUMMARY OF THE INVENTION

In the invention,an indirectly sensed signal of a noise acoustic wave, made up of a series of sequential pulses within a repeating period, is processed into a signal to which a noise cancelling system can respond. The processed signal contains the fundamental and the significant harmonic frequencies in the active noise cancellation range,adjusted to the input signal specifications of the active noise cancellation system.

The processing involves producing sequential pulses in periodic increments where the sequential pulses carry harmonic information and the period is related to the fundamental frequency of the source of the noise, dividing out a numerical increment of the pulses into a single converted pulse per period with a width so that the "on" time of the pulses is about 20% or less, removing all harmonic frequencies above the significant low frequency harmonics and blocking any D.C. at the input to the active noise cancellation system.

DESCRIPTION OF THE INVENTION

Figure 1:
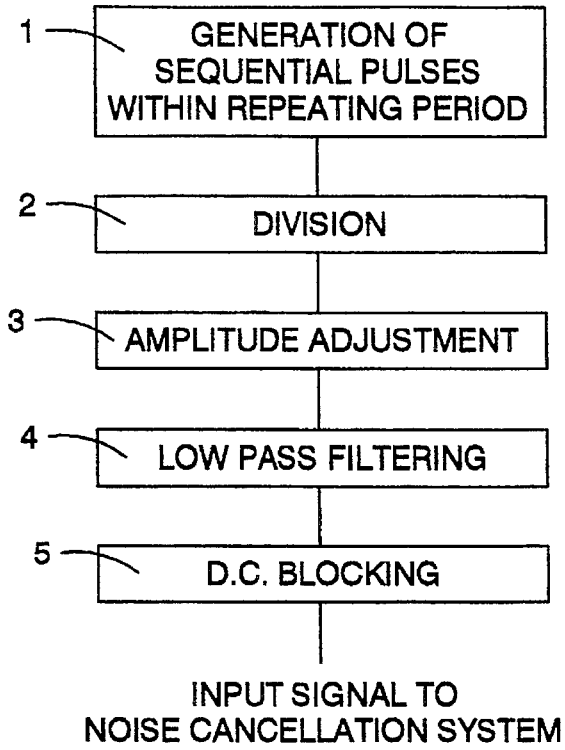
FIG. 1 is a flow chart of the signal processing operations in the invention.

In active noise cancellation the acoustic noise sound wave is estimated and is acoustically cancelled by a cancelling signal which is a convolution of an input signal of the noise sound wave and the output of an adaptive filter that corrects any correlated error between the noise sound wave and the cancelling sound wave. The amount of noise reduction is greatly affected by the degree of correlation between the noise acoustic wave and the input signal representing it. A noise signal, acoustically picked up close to the source of the noise is closely correlated with the noise but not always easily useable. Heretofore in the art indirectly picked up noise signals have not been correlated with the noise principally because the sound power is concentrated at frequencies lower than the repeating frequency. The invention provides principles and operations in implementing them for the use of an indirectly sensed signal of noise having sequential pulses within a repeating period as an input to a noise acoustic wave cancelling system. While the invention is useful in active sound cancellation where the mechanism that generates the noise acoustic wave can be caused to produce a sequential series of pulses within repetitive periods, the invention is particularly useful in sound cancellation with rotary machinery such as an engine where the repeating period is a revolution, and the sequential pulses are producible by sensing, as is done in many tachometers, the passing of teeth on a wheel mounted on a crankshaft. For purposes of description clarity, the principles of the invention are illustrated in connection with the cancellation of the noise acoustic wave produced by an internal combustion engine using a tachometer type indirectly sensed signal that is processed in accordance with the invention to be representative of that noise acoustic wave. In accordance with the invention the processing involves providing a signal in the form of sequential digital pulses within periods related to the fundamental frequency of the noise wherein the periods carry information related to the fundamental frequency and the pulses carry information related to the harmonics, controlling the power to be compatible with the rapid convergence of a sound cancellation algorithm and generating an analog signal correlated with the fundamental and significant low frequency harmonics that meets the specifications of the input of an active sound cancellation system. The principles of the invention are achieved in an embodiment involving the RPM of an engine, by providing a tachometer type RPM signal of a stream of pulses with a specific number per revolution,dividing out an increment of those pulses to form the basis of a single converted pulse per revolution signal, the pulse width of which is arranged to be "on" 20% or less of the time. The amplitude of the single pulse per revolution signal is adjusted, all harmonics above a predetermined value are removed with a low pass filter and any D.C is capacitively isolated from the input of the sound cancellation algorithm. Preferably the predetermined value is approximately 500 Hz. The analog signal of the fundamental and significant low frequency harmonic frequencies serves as an input signal for an active noise cancellation system.

Referring to FIG. 1 a flow chart is provided of the signal processing operations of the invention. In a first operation labelled element 1 there is the generation of a signal having the characteristics that there are a series of pulses within a repeating period. In the illustrative example of the RPM of an engine a tachometer type signal having a series of pulses each revolution of the engine will contain the frequency information needed for an input signal to an adaptive Filtered X type of algorithm in an active noise cancellation system.

In a second operation labelled element 2 an increment of the pulses are divided out of the tachometer type stream of pulses signal and are converted to a single shaped pulse per period which in this example is a revolution with a selected width or "on time". A counter can accomplish the pulse count and a logic circuit with inputs from appropriate locations in the counter can terminate the single pulse at the selected width.

In a third operation labelled element 3 the amplitude of the "single pulse per revolution" signal which at this point is essentially the output level of the elements of the counter and logic circuit is adjusted for power level and compatibility with subsequent filtering and input specifications of the noise cancellation system to which it is to be attached.

In a fourth operation labelled element 4 the signal is subjected to low pass filtering with a cut off frequency of a predetermined frequency, such as, for example about 500 Hz, to preserve all low frequency significant harmonics while eliminating the higher frequency harmonics. Harmonics at frequencies higher than the predetermined value produce an effect known in the art as aliasing and are detrimental to the efficient operation of the cancellation system algorithm.

In the next operation, labelled element 5, any direct current present at the interface with the noise cancellation system is blocked. This is conveniently done with capacitive coupling that passes the analog signal containing the fundamental and low frequency harmonics only. The resulting signal from the operations of FIG.1 contains the fundamental and low significant harmonic frequency information under specifications compatible with the input requirements of the Adaptive Filtered X Least Mean Squares (LMS) type of algorithm in a noise cancellation system.

Figure 2:
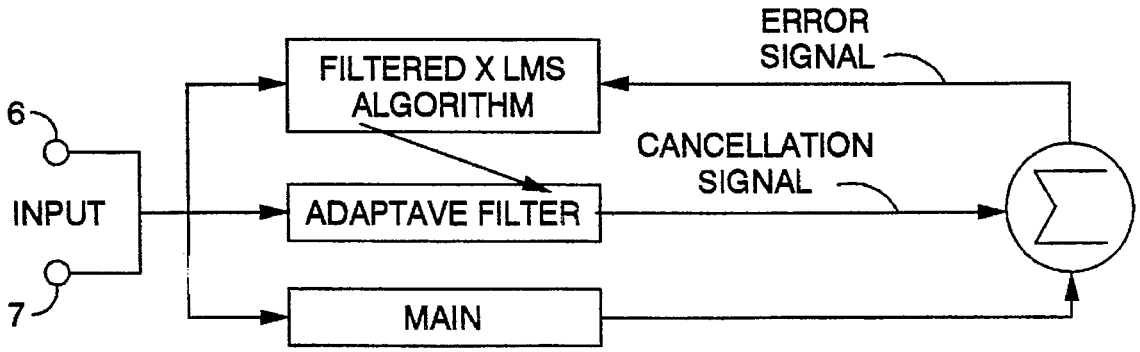
FIG. 2 is a schematic diagram of the functional blocks in a noise acoustic signal algorithm useable with the invention.
Figure 3:
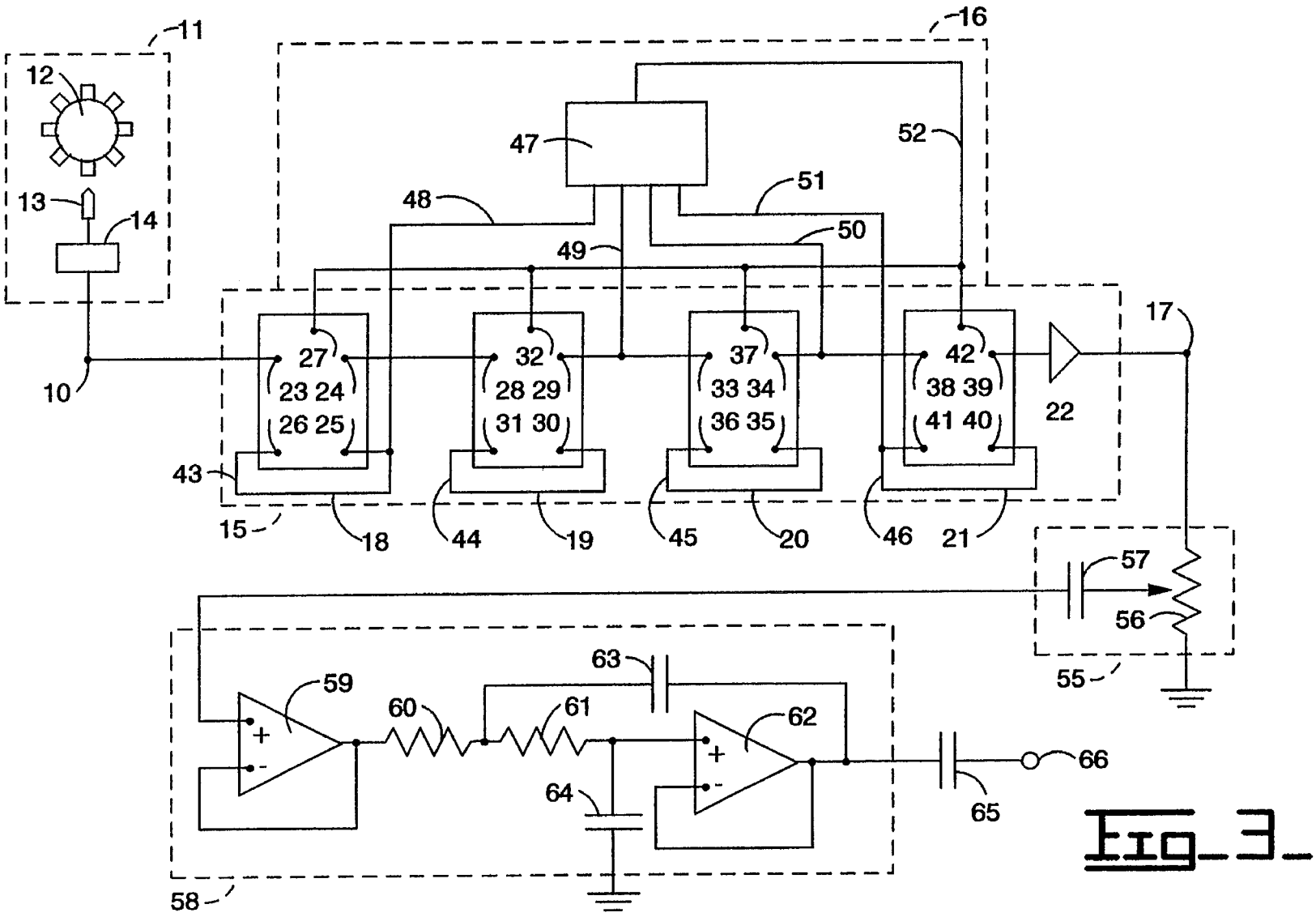
FIG. 3 is a circuit diagram of an embodiment implementing the operations of FIG. 1.
Figure 4:
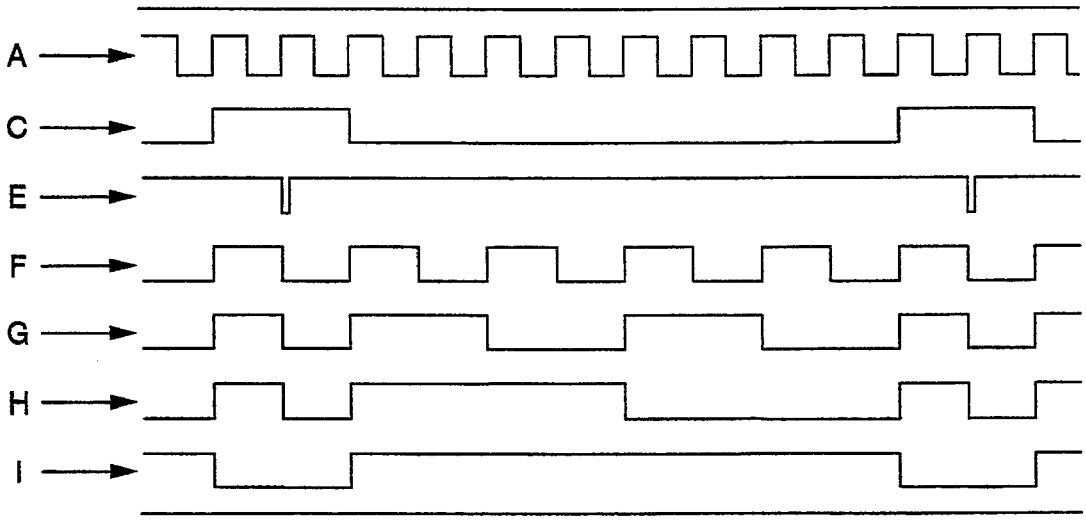
FIG. 4 is a print of a computer simulation of the relative timing in operation of the circuit of FIG. 3.
Figure 5:
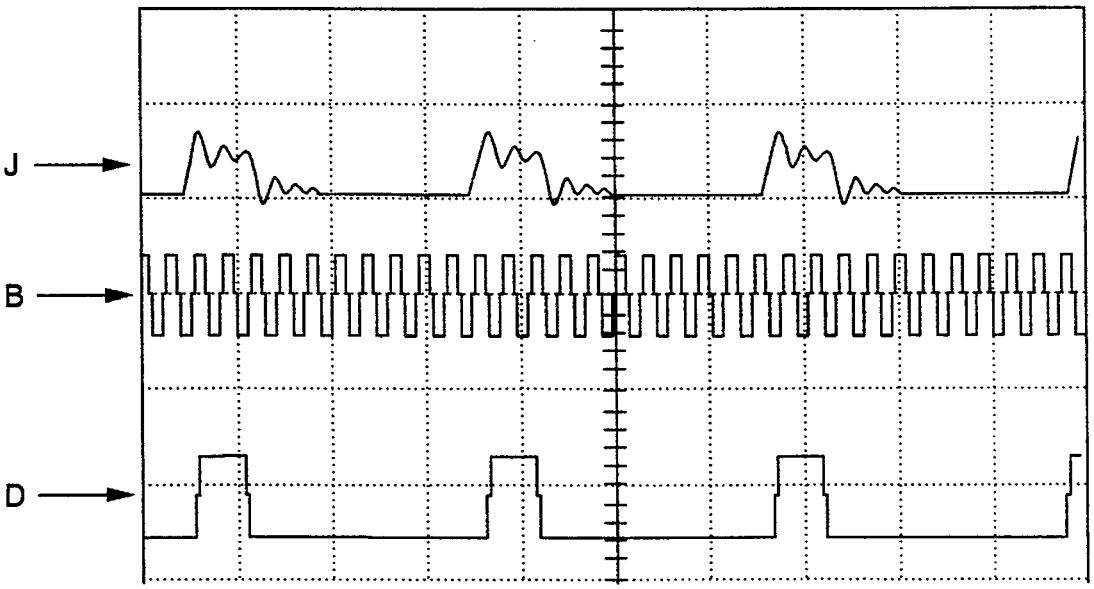
FIG. 5 is a graph of the signals at points in the circuit of FIG. 3.

Referring to FIG. 2 there is shown a diagram of the functional blocks in a state of the art Adaptive Filtered X Least Mean Squares type of algorithm in a noise cancellation system to which the processed signal of FIG. 1 is applied as an input at either of terminals 6 or 7. With the processed signal in accordance with the invention it becomes possible to introduce into a state of the art noise cancellation system both indirectly sensed type noise input signals at one input terminal such as terminal 6 and direct acoustically sensed type noise input signals at another input terminal such as terminal 7. In FIG. 2 the elements represent the functions of variables that influence the cancelling signal. The algorithm operates by calculating a correction based on an error signal, adjusting an adaptive filter for the cancelling signal which is delivered to the location where the noise is to be cancelled through a speaker which is monitored by a monitoring microphone in the cancellation signal path between the adaptive filter and the summing element. The corrections are repeated in a series of cycles until a minimum variation is achieved. Noise cancellation controllers with adaptive algorithms as in FIG. 2 are available commercially as integrated circuits. Analog to digital conversion for the internal digital signal processing (DSP) in the algorithm is done in the integrated circuit of the controller. Such controllers however have certain characteristics that place some limitations on an input signal for compatibility. One such characteristic is that the efficiency with which the algorithm can converge to a minimum variation is improved where the fundamental and the significant low frequency harmonics are all at an essentially even level of power. Another such characteristic is that harmonic frequencies in the signal that are beyond the useful range of active sound cancellation produce a detrimental situation in the art known as aliasing and should be removed. A third such characteristic is that the signals are small and any D.C. should be blocked. The processed signal of the invention addresses the requirements of each of the characteristics. In FIGS. 3, 4 and 5 a circuit embodiment is shown that implements the principles of the invention, in which FIG. 3 is a diagram of the circuit, FIG. 4 is a computer simulation of signal levels at points in the circuit and FIG. 5 shows the signals at the input node, at the output node and at an intermediate node location following the division operation 2 of FIG. 1.

Referring to FIGS. 3,4 and 5,the signal at the input node 10 is produced by a tachometer type RPM signal generator 11 with a ten toothed wheel driven by the crankshaft of the engine,not shown,having a magnetic pickup 13 and pulse defining electronics 14. The input signal at input node 10 is thus a series of ten serial pulses in a period defined by each revolution of the engine. The input pulses are shown in FIG.4 as signal trace A, and in FIG. 5 as signal trace B. The division operation 2 of FIG. 1 is provided in FIG. 3 by a counter section 15 in dotted outline, and a logic section 16 in dotted outline, that together produce a single pulse at node 17, shown as trace C in FIG. 4 and trace D in FIG. 5, that carries information concerning the harmonics, while the frequency of the single pulses carries information concerning the fundamental frequency. The counter section 15 is made up of a series of four bistable switching elements 18, 19, 20, and 21, known in the art as flip-flops. The switching elements 18–21 are connected as a binary counter, the output of which is followed by an inverter element 22. Each switching element, taking element 18 for explanation, has a clock input 23, an "on" output 24, an "off" output 25, a "set" input 26 and a "clear" input 27. Elements 28, 29, 30, 31 and 32 perform the respective same functions for switching element 19; 33, 34, 35, 36, and 37 for switching element 20; and, 38, 39, 40, 41 and 42 for switching element 21. Each switching element is connected for bistable operation by a conductor labelled element 43, 44, 45,and 46 from the "off" output to the "set" input for each of the switching elements 18–21.

The logic section 16 is a four input "Nand" element 47 having positive signal inputs 48, 49, 50 and 51 and delivering a negative output signal on line 52 that in turn is connected to the "clear" terminals 27, 32, 37 and 42 of the switching elements 18–21. The "clear" signal is shown in FIG. 4 as trace E. The signal out of the Nand element 47 clears all switching elements 18–21, setting the "off" terminals 25, 30, 35 and 40 "high" and the "on" terminals 24, 29,34 and 39 "low". The Nand 47 inputs 48–51 are connected to sense that elements 18 and 21 of the counter are "off" and elements 19 and 20 are on. The traces F, G, H, and I in FIG. 4 are the levels at outputs 24, 29, 34 and 39 respectively in the circuit of FIG. 3 during the pulses at node 10 during a revolution of the wheel 12. The division circuitry of the counter 15 and logic element 16 is thus a function of the number of teeth in the wheel 12.

In operation, in the stream of pulses at input node 10 as shown from traces A and B in FIGS. 4 and 5, the signal from the Nand 47 clears all elements 18–21 setting output 39 low which is inverted by element 22 to provide the lead portion of the pulses in trace D of FIG. 5 and trace C of FIG. 4. The counter then counts pulses to a point where the output 39 is high at which point the inverter 22 provides the terminating negative shift for the single pulse as shown in trace C of FIG. 4 and trace D of FIG. 5. The width of the single pulse per revolution pulses of traces C and D is selectable by the count in the counter delivered on the inputs to the Nand circuit and is selected to be about 20% of the leading shifts of the pulses, that is, the frequency of the pulses.

The amplitude adjustment operation 3 of FIG. 1 is achieved in FIG. 3 by a section 55 in dotted outline wherein the amplitude of the signal is reduced to a selected magnitude with a variable resistance 56 with one terminal connected to ground and the signal passed through capacitive coupling 57 to the next stage.

The low pass filter operation 4 of FIG. 1 is achieved in FIG. 3 by a section 58 in dotted outline, made up of an isolating buffering operational amplifier 59 and a standard in the art low frequency passing filter circuit made up of two resistances 60 and 61 in series with an operational amplifier 62 and having one capacitor 63 connected from a point between the resistors 60 and 61 to the output of the operational amplifier 62 and with another capacitor 64 connected from the input of the operational amplifier to ground.

The D.C. blocking operation 5 of FIG. 1 is achieved in FIG. 3 by a capacitive coupling 65 between the output of the operational amplifier 62 and the output node 66 of the circuit. In FIG. 5 a signal trace J illustrates the analog output signal at node 66 that serves as the input to the noise cancellation system in FIG. 2.

A switch, not shown, for convenience in assembling a system may be placed in the line between the operational amplifier 62 output and the capacitive coupling 65.

In order to provide a starting place for one skilled in the art in practicing the invention the following specifications of the embodiment described in connection with FIGS. 3, 4 and 5 are provided; it being understood that the invention not being limited thereby.

Input Signal Pulses—0–5 Volts—10 per revolution
Trace A—312.5 Hz.
Trace B—32.468 Hz.
Trace C—32.468 Hz.
Switching elements 18–21—Motorola 74F74 D type Flip flop
Inverter element 22—Motorola 74HC04 Inverter
Nand element 47—Texas Instruments 74SN20 Multiple Input Nand Gate
Operational Amplifier elements 59 and 62—Motorola TL074CN Quad. Op. Amp.
Resistor elements 60 and 61—18 K ohms.
Variable resistor element 56—20 K ohms.
Capacitor element 57—0.01 micro farad
Capacitor elements 63 and 64—0.02 micro farad
Capacitor element 65—47 micro farads What has been described is the processing of an indirectly sensed signal representative of a noise acoustic wave into an input for an active noise cancellation system involving forming serial pulses carrying harmonic information within a period related to the fundamental frequency.

What is claimed is:

1. The method of providing an indirectly sensed noise input signal for introduction at an active noise cancellation system input, comprising in combination the steps of:

generating a signal representative of said noise, said signal having sequential pulses within repeating periods, dividing, an increment of said sequential pulses, out of the sequential pulses in each individual period, forming each said increment of said sequential pulses into a single, controlled width, converted pulse signal, per period, reducing the amplitude of each said converted pulse signal, A filtering from each said converted pulse signal all frequencies above a predetermined value, and, blocking any direct current from said input of said active noise cancellation system.

2. The method of claim 1 wherein the predetermined value is 500 Hz.

3. The method of claim 1 where said dividing out step is accomplished by a sequential pulse counter and an interconnected multiple input logic circuit that provides a signal at a selected count of said counter.

4. The method of claim 3 wherein the width of said controlled width converted pulses signals is by selection of the number of said sequential pulses counted in said increment, to be 20% or less of said period.

5. The method of claim 4 wherein said direct current blocking step is performed by capacitive coupling.

6. The method of producing a signal representative of, and correlated with, an acoustic noise wave associated with a rotating machine, comprising in combination the steps of:

providing signals each having sequential pulses within each revolution of said machine, forming a converted pulse signal for each said revolution of said machine each said converted pulse signal having a duration of an increment of said sequential pulses, said duration being 20% or less of the duration of each said revolution of said machine, reducing the amplitude of said converted pulse signals, filtering from said converted pulse signals all frequencies above a predetermined value, and providing capacitive coupling at an output.

7. The method of claim 6 wherein the predetermined value is 500 Hz.

8. The method of claim 6 wherein said step of forming a converted pulse signal for each revolution of said machine is accomplished by a sequential pulse counter and an interconnected multiple input logic circuit that provides a signal at a selected count of said counter.

9. A signal conversion circuit for converting a signal representative of noise, said signal having sequential pulses within repeating periods, into an analog signal coordinated with the fundamental and low frequency harmonic frequencies of said noise, comprising:

a converted pulse with controlled width forming stage, where said width of said converted pulse is a selected portion of one of said repeating periods, said forming stage including a sequential pulse counter and a multiple input logic circuit, said sequential pulse counter being interruptable by the output signal of said multiple input logic circuit and the inputs of said multiple input logic circuit being connected into said sequential pulse counter at points determinative of said selected portion of one of said repeating periods, and, serially connected, following said forming stage, a converted pulse amplitude reducing stage, a low frequency passing filtering stage, and, a direct current blocking stage.

10. The circuit of claim 9 wherein said pulse counter is a binary counter of bistable transistor circuits with an inverter at the output.

11. The circuit of claim 10 wherein said logic circuit is a multiple input Nand circuit with inputs connected to selected transistor circuits in said counter and with the output signal therefrom connected to reset all said transistor circuits.

12. The circuit of claim 11 wherein said converted pulse amplitude reducing stage includes a variable resistor.

13. The circuit of claim 9 wherein said direct current blocking stage is a capacitive coupling.

14. In a periodic acoustic noise sound cancellation system of the type wherein a cancelling acoustic wave is provided at a location, said cancelling wave being determined by iterative computations based on input signals representing said noise and feedback signals from monitoring at said location, an improved input signal comprising:

a source of sequential pulses within a repeating period of said noise, signal generating means for forming, a single pulse per period of said repeating periods signals, said single pulse per period signals having a duration of 20% or less of said repeating period, and, signal adjusting means to deliver, as at least a portion of said input signals to said system, a signal containing the low frequency fundamental and harmonic component information of said single pulse per period signals.

15. The improved input signal of claim 14 wherein the duration of said single pulse per period signals is determined by a selectable count of said sequential pulses.

16. The improved input signal of claim 15 wherein said source of sequential pulses within repeating periods of said noise is a multitoothed wheel RPM signal generator.

17. The improved input signal of claim 16 wherein said signal generating means for forming a single pulse per period of said repeating periods signals is a binary counter reset by a logic circuit at said 20% or less signal duration.

* * * * *

UNITED STATES PATENT AND TRADEMARK OFFICE

CERTIFICATE OF CORRECTION

PATENT NO. : 5,502,770

DATED : March 26, 1996

INVENTOR(S) : Kuo et al

It is certified that error appears in the above-identified patent and that said Letters Patent is hereby corrected as shown below:

In claim 1, column 6, line 56, remove the word "A".

In claim 4, column 6, line 67, please delete "pulses signals is" and insert --pulse signals is--.

Signed and Sealed this

Thirtieth Day of July, 1996

Bruce Lehman

*Attest:*

BRUCE LEHMAN

*Attesting Officer*

*Commissioner of Patents and Trademarks*